US006953645B2

(12) United States Patent
Kim et al.

(10) Patent No.: US 6,953,645 B2
(45) Date of Patent: Oct. 11, 2005

(54) PREPARATION OF NANOCAPSULE COMPOSITIONS AND THEIR TONER COMPOSITION FOR THERMOSENSITIVE REWRITABLE RECORDING MEDIA

(75) Inventors: Eun Kyoung Kim, Daejeon (KR); Young Soon Kim, Seoul (KR); Soo Kyung Kim, Daejeon (KR)

(73) Assignee: Korea Research Institute of Chemical Technology, Daejeon (KR)

( * ) Notice: Subject to any disclaimer, the term of this patent is extended or adjusted under 35 U.S.C. 154(b) by 96 days.

(21) Appl. No.: 10/429,882

(22) Filed: May 6, 2003

(65) Prior Publication Data

US 2003/0215729 A1 Nov. 20, 2003

(30) Foreign Application Priority Data

May 7, 2002 (KR) ..... 2002-25082

(51) Int. Cl.[7] ..... G03G 9/09; B41M 5/28

(52) U.S. Cl. ..... 430/108.1; 430/108.21; 430/108.4; 503/201; 503/215

(58) Field of Search ..... 430/108.1, 108.2, 430/108.21, 108.4; 503/201, 215, 226

(56) References Cited

U.S. PATENT DOCUMENTS

| | | | | |
|---|---|---|---|---|
| 5,637,551 | A | 6/1997 | Watanabe et al. | |
| 5,932,137 | A * | 8/1999 | Baba et al. | 252/299.66 |
| 6,174,836 | B1 | 1/2001 | Hotta et al. | |
| 6,207,613 | B1 * | 3/2001 | Torii et al. | 503/201 |
| 6,753,083 | B2 * | 6/2004 | Mistry et al. | 428/402 |

* cited by examiner

*Primary Examiner*—John L Goodrow
(74) *Attorney, Agent, or Firm*—Finnegan, Henderson, Farabow, Garrett & Dunnrer, LLP

(57) ABSTRACT

The present invention relates to a nanocapsule composition and its toner composition for thermosensitive rewritable recording media, more particularly to a core/shell-type nanocapsule composition for thermosensitive rewritable recording media, which has fine capsule of a few nanometers in size and superior recording property and heat stability, a preparation method thereof and its toner composition for thermosensitive rewritable recording media. The toner composition according to the present invention is suitable for high-resolution electrostatic image toner, paper and film. Also, it enables reuse of recording media because the recording is erased when the media (e.g.: paper and OHP film) is heated to a high temperature.

34 Claims, 1 Drawing Sheet

PREPARATION OF NANOCAPSULE COMPOSITIONS AND THEIR TONER COMPOSITION FOR THERMOSENSITIVE REWRITABLE RECORDING MEDIA

BACKGROUND OF THE INVENTION

Field of the Invention

The present invention relates to preparation of nanocapsule composition and its toner composition for thermosensitive rewritable recording media, more particularly to core/shell-type nanocapsule composition for thermosensitive rewritable recording media, which has fine nanometer capsule size and superior recording property and heat stability, preparation method thereof and its toner composition for thermosensitive rewritable recording media. The toner composition according to the present invention is suitable for high-resolution electrostatic image toner, paper and film. Also, it enables reuse of rewritable media because the recording is erased when the media (e.g.: paper and OHP film) is heated to high temperature.

The advent of information age, rapid development of computer technology, fast spread of user-friendly network environment and progress in digital technology caused quantitative growth of office environment. Also, because the digital information is ultimately printed in recording media like paper or film, demand of recording media has grown explosively with the growth of information technology. In relation to this, waste recording media like waste paper or waste film are apparaing as new environmental problem. To solve this problem, development of environment-friendly rewritable recording media is under way.

U.S. Pat. No. 5,637,551 discloses a preparation method of a reversible thermosensitive recording material, which uses capsule containing thermosensitive nucleus. It discloses thermosensitive rewritable recording material whose transparency-cloudiness/coloring process is reversibly controlled by temperature. However, the clouded recording is not easily identifiable. And, because the capsule size is as large as 0.5–100 μm, the heat stability and recording resolution is poor.

U.S. Pat. No. 6,174,836 discloses a thermosensitive rewritable recording material wherein low-molerclaur-weight organic material is dispersed in resin. Here, temperature-dependent phase change of the organic material controls transparency-cloudiness process reversibly. However, the recording is not easily identifiable in this method, either. Also, the organic material dispersed in resin may be decomposed at high temperatures.

U.S. Pat. No. 6,207,613 discloses a reversible thermosensitive coloring composition whose coloring/erasing is conrolled by temperature, using an electron donating coloring agent and an electron accepting color developer. However, this method requires temperature control for coloring/erasing, wherein the composition achieves an erased state (colorless state) when heated at a relatively low temperatue (e.g. below 150° C.). Thus recording mark based on this composition cannot be retained under high temperature conditions.

Because of these reasons, there exists a need for a reversible thermosensitive recording material which has good image formation/erasure ability and rapid erasability, and particularly has good preservability even when preserved under high temperature conditions.

SUMMARY OF THE INVENTION

The inventors investigated the method of encapsuling coloring compounds (dyes or pigments) with color developing compounds (developers) in order to develop reusable recording media, which can be recorded at a temperature lower than 100° C. and is thermally stable (erasing temperature: higher than 160° C.). Especially, the inventors found that core/shell-type capsule composition, which comprises coloring compounds, developing compounds, monomers, initiators, and solvents or water, can encapsule the coloring compounds and developers and provides a reusable and thermally stable recording material. Also, because this composition needs not to be crushed to fine particles, energy consumption is reduced in the production of recording materials. In addition, because the capsule size is as small as 0.01–3 μm (conventionally 0.5–100 μm), it is sutiable for toner, paper or film for high-resolution electrostatic image.

Accordingly, an object of the present invention is to provide a nanocapsule composition for core/shell-type thermosensitive rewritable recording media, which has fine average particle size and superior heat stability and is suitable for high-resolution electrostatic image toner. Further, another object of the present invention is to provide a method for preparing the nanaocapsule compositon and a toner compositon used thereof.

DETAILED DESCRIPTION OF THE INVENTION

Figure 1:
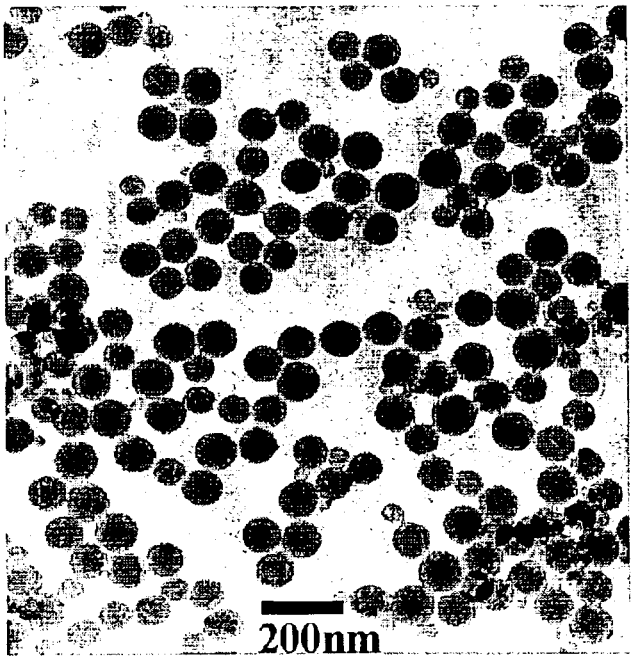
FIG. 1 is TEM photograph of capsule composition prepared in Example 1, of the present invention.

The present invention relates to a core/shell-type capsule composition, which comprisies 0.1–30 parts by weight of coloring compounds that can be colored by itself or by couping with a developer, 0.1–60 parts by weight of developer(s), 15–80 parts by weight of monomer(s) capable of radical polymerization, 0.1–10 parts by weight of radical polymerization initiator(s) and 20–80 parts by weight of solvent(s) or water, wherein polymer formed from the monomer(s) surrounds the coloring compounds and developer(s) and the particle diameter falls in the range of 10–3000 nm.

Hereunder is given a more detailed description about the capsule composition according to this invention.

The coloring compound(s) are one or more compound selected from the group consisting of fluoran, phthalide, spiropyran, spiroxazine, diaryl ethene and azobenzene. It can be purchased from Sigma-Aldrich, Merck Yamamoto, Shin Nisso and Hodogaya, or can be synthesized by known methods (U.S. Pat. Nos. 6,207,613 & 20010327; Korean Patent Nos. 285610 & 303100). The coupler(s) are recommended to use in the amount of 0.1–30 parts by weight. If its content falls outside this range, capsule may not be formed.

Examples of such coupler(s) are as follows:

Fluorans like 2'-(o-chloroanilino)-6'-(dibutylamino) fluoran, 3-(diethylamino)-7-(dibenzylamino)fluoran, 3-diethylamino-6-methyl-7-p-butylanilino-fluoran, 2'-anilino-3'-chloro-6'-(diethylamino)fluoran, 3'-(diethylamino)-7'-(3'-trifluoromethylphenylamino)fluoran, 3'chloro-6'-(cyclohexylamino)fluoran, 2-[(2',4',6'-trimethylphenyl)amino]-8-(diethylamino)benzo[c]fluoran, 4-amino-8-diethylamino-benzo[a]fluoran, 7-anilino-3-(diethylamino)fluoran, 3-(diethylamino)-7-(methylamino) fluoran, 2-anilino-6-(N-n-hexyl-N-ethylamino)fluoran, 4-benzylamino-8-diethylaminobenzo[a]fluoran, 2-anilino-3-methyl-6-(N-ethyl-p-toluidino)fluoran, 2-(octylamino)-6-(diethylamino)fluoran, 1-methyl-3-[bis(phenylmethyl)amino]-7-(diethylamino)fluoran, 2-anilino-3-methyl-6-diethylaminofluoran, 2-anilino-3-methyl-6-(di-n-butylamino)fluoran, 2-anilino-3-methyl-6-(N-n-propyl-N-methylamino)fluoran, 2-anilino-3-methyl-6-(N-isopropyl-N-methylamino)fluoran, 2-anilino-3-methyl-6-(N-isobutyl-N-methylamino)fluoran, 2-anilino-3-methyl-6-(N-n-amyl-N-methylamino)fluoran, 2-anilino-3-methyl-6-(N-sec-butyl-N-methylamino)fluoran, 2-anilino-3-methyl-6-(N-n-amyl-N-ethylamino)fluoran, 2-anilino-3-methyl-6-(N-n-isoamyl-N-ethylamino)fluoran, 2-anilino-3-methyl-6-(N-n-propyl-N-isopropylamino)fluoran, 2-anilino-3-methyl-6-(N-cyclohexyl-N-methylamino)fluoran, 2-anilino-3-methyl-6-(N-ethyl-p-toluidino)fluoran, 2-anilino-3-methyl-6-(N-methyl-p-toluidino)fluoran, 2-(m-trichloromethylanilino)-3-methyl-6-diethylaminofluoran, 2-(m-trifluoromethylanilino)-3-methyl-6-diethylaminofluoran, 2-(m-trichloromethylanilino)-3-methyl-6-(N-cyclohexyl-N-methylamino)fluoran, 2-(2,4-dimethylanilino)-3-methyl-6-diethylaminofluoran, 2-(N-ethyl-p-toluidino)-3-methyl-6-(N-ethylanilino)fluoran, 2-(N-ethyl-p-toluidino)-3-methyl-6-(N-propyl-p-toluidino)fluoran, 2-anilino-6-(N-n-hexyl-N-ethylamino)fluoran, 2-(o-chloroanilino)-6-aminofluoran, 2-(m-trimethylanilino)-6-diethylaminofluoran, 2,3-dimethyl-6-dimethylaminofluoran, 3-methyl-6-(N-ethyl-p-toluidino)fluoran, 2-chloro-6-diethylaminofluoran, 2-bromo-6-diethylaminofluoran, 2-chloro-6-dipropylaminofluoran, 3-chloro-6-cyclohexylaminofluoran, 3-bromo-6-cyclohexylaminofluoran, 2-chloro-6-(N-ethyl-N-isoamylamino)fluoran, 2-chloro-3-methyl-6-diethylaminofluoran, 2-anilino-3-chloro-6-diethylaminofluoran, 2-(o-chloroanilino)-3-chloro-6-cyclohexylaminofluoran, 2-(m-trifluoromethylanilino)-3-chloro-6-diethylaminofluoran, 2-(2,3-dichloroanilino)-3-chloro-6-diethylaminofluoran, 1,2-benzo-6-diethylaminofluoran, 3-diethylamino-6-(m-trifluoromethylanilino)fluoran, 2-(p-acetylanilino)-6-(N-n-amyl-N-n-butylamino)fluoran, 2-benzylamino-6-(N-ethyl-p-toluidino)fluoran, 2-benzylamino-6-(N-methyl-2,4-dimethylanilino)fluoran, 2-benzylamino-6-(N-ethyl-2,4-dimethylanilino)fluoran, 2-dibenzylamino-6-(N-methyl-p-toluidino)fluoran, 2-dibenzylamino-6-(N-ethyl-p-toluidino)fluoran, 2-(di-p-methylbenzylamino)-6-(N-ethyl-p-toluidino)fluoran, 2-(α-phenylethylamino)-6-(N-ethyl-p-toluidino)fluoran, 2-methylamino-6-(N-methylanilino)fluoran, 2-methylamino-6-(N-ethylanilino)fluoran, 2-methylamino-6-(N-propylanilino)fluoran, 2-ethylamino-6-(N-methyl-p-toluidino)fluoran, 2-methylamino-6-(N-methyl-2,4-dimethylanilino)fluoran, 2-ethylamino-6-(N-ethyl-2,4-dimethylanilino)fluoran, 2-dimethylamino-6-(N-methylanilino)fluoran, 2-dimethylamino-6-(N-ethylanilino)fluoran, 2-diethylamino-6-(N-methyl-p-toluidino)fluoran, 2-diethylamino-6-(N-ethyl-p-toluidino)fluoran, 2-dipropylamino-6-(N-methylanilino)fluoran, 2-dipropylamino-6-(N-ethylanilino)fluoran, 2-amino-6-(N-methylanilino)fluoran, 2-amino-6-(N-ethylanilino)fluoran, 2-amino-6-(N-propylanilino)fluoran, 2-amino-6-(N-methyl-p-toluidino)fluoran, 2-amino-6-(N-ethyl-p-toluidino)fluoran, 2-amino-6-(N-propyl-p-toluidino)fluoran, 2-amino-6-(N-methyl-p-ethylanilino)fluoran, 2-amino-6-(N-ethyl-p-ethylanilino)fluoran, 2-amino-6-(N-propyl-p-ethylanilino)fluoran, 2-amino-6-(N-methyl-2,4-dimethylanilino)fluoran, 2-amino-6-(N-ethyl-2,4-dimethylanilino)fluoran, 2-amino-6-(N-propyl-2,4-dimethylanilino)fluoran, 2-amino-6-(N-methyl-p-chloroanilino)fluoran, 2-amino-6-(N-ethyl-p-chloroanilino)fluoran, 2-amino-6-(N-propyl-p-chloroanilino)fluoran, 1,2-benzo-6-(N-ethyl-N-isoamylamino)fluoran, 1,2-benzo-6-dibutylaminofluoran, 1,2-benzo-6-(N-ethyl-N-cyclohexylamino)fluoran, 1,2-benzo-6-(N-ethyl-N-toluidino)fluoran, 2-anilino-3-methyl-6-(N-2-ethoxypropyl-N-ethylamino)fluoran, 2-(p-chloroanilino)-6-(N-n-octylamino)fluoran, 2-(p-chloroanilino)-6-(N-n-palmitylamino)fluoran, 2-(p-chloroanilino)-6-(di-n-octylamino)fluoran, 2-benzoylamino-6-(N-ethyl-p-toluidino)fluoran, 2-(o-methoxybenzoylamino)-6-(N-methyl-p-toluidino)fluoran, 2-dibenzylamino-4-methyl-6-diethylaminofluoran, 2-dibenzylamino-4-methoxy-6-(N-methyl-p-toluidino)fluoran, 2-dibenzylamino-4-methyl-6-(N-ethyl-p-toluidino)fluoran, 2-(α-phenylethylamino)-4-methyl-6-diethylaminofluoran, 2-(p-toluidino)-3-(t-butyl)-6-(N-methyl-p-toluidino)fluoran, 2-(o-methoxycarbonylanilino)-6-diethylaminofluoran, 2-acetylamino-6-(N-methyl-p-toluidino)fluoran, 4-methoxy-6-(N-ethyl-p-toluidino)fluoran, 2-ethoxyethylamino-3-chloro-6-dibutylaminofluoran, 2-dibenzylamino-4-chloro-6-(N-ethyl-p-toluidino)fluoran, 2-(α-phenylethylamino)-4-chloro-6-diethylaminofluoran, 2-(N-benzyl-p-trifluoromethylanilino)-4-chloro-6-diethylaminofluoran, 2-anilino-3-methyl-6-pyrrolidinofluoran, 2-anilino-3-chloro-6-pyrrolidinofluoran, 2-anilino-3-methyl-6-(N-ethyl-N-tetrahydrofurfurylamino)fluoran, 2-mezidino-4',5'-benzo-6-diethylaminofluoran, 2-(m-trifluoromethylanilino)-3-methyl-6-pyrrolidinofluoran, 2-(α-naphthylamino)-3,4-benzo-4'-bromo-6-(N-benzyl-N-cyclohexylamino)fluoran, 2-piperidino-6-diethylaminofluoran, 2-(N-n-propyl-p-trifluoromethylanilino)-6-morpholinofluoran, 2-(di-N-p-chlorophenyl-methylamino)-6-pyrrolidinofluoran, 2-(N-n-propyl-m-trifluoromethylanilino)-6-morpholinofluoran, 1,2-benzo-6-(N-ethyl-N-n-octylamino)fluoran, 1,2-benzo-6-diallylaminofluoran and 1,2-benzo-6-(N-ethoxyethyl-N-ethylamino)fluoran;

Phthalides like 3,3-bis(4-dimethylaminophenyl)-6-dimethylaminophthalide, 3-(1-ethyl-2-methylindole-3-yl)-3-(2-ethoxy-4-diethylaminophenyl)-4-azaphthalide, 3-(1-ethyl-2-methylindole-3-yl)-3-(2-ethoxy-4-diethylaminophenyl)-7-azaphthalide, 3-(1-octyl-2-methylindole-3-yl)-3-(2-ethoxy-4-diethylaminophenyl)-4-azaphthalide, 3-(1-ethyl-2-methylindole-3-yl)-3-(2-methyl-4-diethylaminophenyl)-4-azaphthalide, 3-(1-ethyl-2-methylindole-3-yl)-3-(2-methyl-4-diethylaminophenyl)-7-azaphthalide, 3-(1-ethyl-2-methylindole-3-yl)-3-(4-diethylaminophenyl)-4-azaphthalide, 3-(1-ethyl-2-methylindole-3-yl)-3-(4-N-n-amyl-N-methylaminophenyl)-4-azaphthalide, 3-(1-methyl-2-methylindole-3-yl)-3-(2-hexyloxy-4-diethylaminophenyl)-4-azaphthalide, 3,3-bis(2-ethoxy-4-diethylaminophenyl)-4-azaphthalide, 3,3-bis(2-ethoxy-4-diethylaminophenyl)-7-azaphthalide, 3,3-bis(p-dimethylaminophenyl)phthalide, 3,3-bis(p-dimethylaminophenyl)-6-dimethylaminophthalide (or crystal violet lactone), 3,3-bis(p-dimethylaminophenyl)-6-chlorophthalide, 3,3-bis(p-dibutylaminophenyl)phthalide, 3-(2-methoxy-4-dimethylaminophenyl)-3-(2-hydroxy-4,5-dichlorophenyl)phthalide, 3-(2-hydroxy-4-dimethylaminophenyl)-3-(2-methoxy-5-chlorophenyl)phthalide, 3-(2-hydroxy-4-dimethoxyaminophenyl)-3-(2-methoxy-5-chlorophenyl)phthalide, 3-(2-hydroxy-4-dimethylaminophenyl)-3-(2-methoxy-5-nitrophenyl) phthalide, 3-(2-hydroxy-4-diethylaminophenyl)-3-(2-methoxy-5-methylphenyl)phthalide, 3-(2-methoxy-4-dimethylaminophenyl)-3-(2-hydroxy-4-chloro-5-methoxyphenyl)phthalide and 3,6-bis(dimethylamino) fluorenespiro(9,3')-6'-dimethylaminophthalide;

Spiropyrans like 6'-chloro-8'-methoxy-benzoindolino-spiropyran and 6'-bromo-2'-methoxy-benzoindolino-spiropyran;

Lactams like 2-[3,6-bis(diethylamino)]-6-(o-chloroanilino)xanthyl benzoic acid lactam, 2-[3,6-bis (diethylamino)]-9-(o-chloroanilino)xanthyl benzoic acid lactam; and benzoleucomethyleneblue.

The developer(s) are one or more compound selected from the group consisting of —OH containing compounds, —$PO(OH)_2$ containing compounds, monosulfate, bisulfate, citric acid, gallic acid, succinic acid, lactic acid, tartaric acid, valeric acid, DL-malic acid and gluconic acid. It can be purchased from Sigma-Aldrich or Merck, or can be synthesized by known methods (U.S. Pat. Nos. 6,207,613, 2,001, 0327 & 4,918,046). An example of —OH containing compound is 4-hydroxy-4'-isopropoxy-diphenyl sulfone. The developer(s) are recommended to use in the amount of 0.1–60 parts by weight. If its content is outside this range, capsules may not be formed. And, the developer(s) are recommended to use 0.1–10 equivalents of the coloring agent.

For the radical-polymerizable monomer(s), which comprise outer wall of the capsule composition and generates color by reaction with the coloring agent and the developer, one or more compounds selected from the group consisting of substituted or unsubstituted compounds containing an unsaturated group such as styrene, alkyl acrylate, polyalkylene glycol acrylate, acrylic acid and vinylcarbazole, can be used. The monomers are recommended to use in the amount of 15–80 parts by weight. If the monomer content is below 15 parts by weight, it is difficult to form a capsule. In contrast, if it exceeds 80 parts by weight, the polymerization becomes nonhomogeneous and a lot of monomers remain unreacted. And, because the coloring reaction, expressed by Scheme 1, can be performed at −50–120° C., liquid constituent that can dissolve the coupler and developer at room temperature is recommended to use together with the monomer(s).

methacrylate, dimethylaminoethyl methacrylate, methyl chloride of dimethylaminoethyl methacrylate, diethylaminoethyl methacrylate, glycidyl methacrylate, tetrahydrofurfuryl methacrylate, allyl methacrylate, 2-ethoxyethyl methacrylate, 2-ethylhexyl acrylate, 2-ethoxyethyl acrylate, 2-ethoxyethoxyethyl acrylate, 2-hydroxyethyl acrylate, 2-hydroxypropyl acrylate, dicyclopentenyl ethyl acrylate, ethylene glycol dimethacrylate, triethylene glycol dimethacrylate, tetraethylene glycol dimethacrylate, 1,3-butylene glycol dimethacrylate, 1,6-hexanediol dimethacrylate, 1,4-butanediol diacrylate, 1,6-hexanediol diacrylate, 1,9-nonanediol diacrylate, neopentyl glycol diacrylate, tetraethylene glycol diacrylate, tripropylene glycol diacrylate, polypropylene glycol diacrylate, diacrylate esters prepared from bisphenol A with ethylene oxide, glycerin methacrylate acrylate, diacrylate esters prepared from neopentyl glycol with 2 mol of propylene oxide, diethylene glycol diacrylate, polyethylene glycol (400) diacrylate, diacrylate esters of an ester of hydroxy pivalate and neopentyl glycol, 2,2-bis(4-acryloyloxydiethoxyphenyl) propane, neopentyl glycol diadipate diacrylate, diacrylate esters prepared from neopentyl glycol hydroxypivalate with .epsilon.-caprolactone, 2-(2-hydroxy-1,1-dimethylethyl)-5-hydroxymethyl-5-ethyl-1,3-dioxane diacrylate, tricyclodecane dimethylol diacrylate, products of tricyclodecane dimethylol diacrylate with .epsilon.-caprolactone, and 1,6-hexanediol glycidyl ether diacrylate, trimethylol propane trimethacrylate, trimethylol propane triacrylate, acrylate esters prepared from glycerin with propylene oxide, trisacryloyloxyethyl phosphate, pentaerythritol acrylate, triacrylate esters prepared from trimethylol propane with three moles of propylene oxide, dipentaerythritol polyacrylate, polyacrylate esters prepared from dipentaerythritol with .epsilon.-caprolactone, dipentaerythritol propionate triacrylate, triacrylate esters of hydroxypivalic aldehyde modified with dimethylol propane, dipentaerythritol propionate tetraacrylate, ditrimethylol propane tetraacrylate, dipentaerythritol propionate pentaacrylate, dipentaerythritol hexaacrylate and products of dipentaerythritol hexaacrylate with .epsilon.-caprolactone.

For the radical polymerization initiator(s), one or more compounds selected from the group consisting of N,N'-azo bisisobutyronitrile, potassium persulfate, isobutyl benzoin ether, isopropyl benzoin ether, benzoin ethyl ether, benzoin Scheme 1

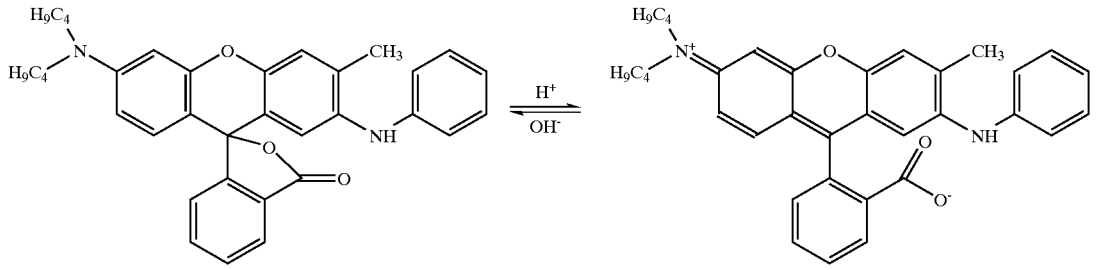

Examples of such monomer(s) are as follows: styrene, α-methylstyrene, methyl methacrylate, ethyl methacrylate, n-butyl methacrylate, isobutyl methacrylate, t-butyl methacrylate, 2-ethylhexyl methacrylate, lauryl methacrylate, tridecyl methacrylate, stearyl methacrylate, cyclohexyl methacrylate, benzyl methacrylate, methacrylic acid, 2-hydroxyethyl methacrylate, 2-hydroxypropyl methyl ether, 1-phenyl-1,2-propanedione-2-(o-ethoxycarbonyl)oxime, 2,2-dimethoxy-2-phenyl acetophenone, benzyl hydroxycyclohexylphenyl ketone, diethoxy acetophenone, 2-hydroxy-2-methyl-1-phenylpropane-1-one, benzophenone, 1-chlorothioxanthone, 2-chlorothioxanthone, isopropylthioxanthone, 2-methylthioxanthone, 2-chlorobenzophenone and azo-polyethylene glycol (Formula 1), can be used.

Formula 1

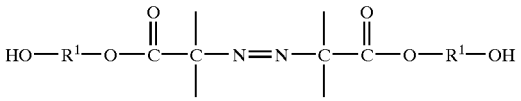

In Formula 1, $R^1$ is ethyl, butyl, hexyl, dioxaoctyl, triethyleneoxide or polyethyleneoxide.

The radical polymerization initiator is recommended to use 0.1–10 parts by weight. If the initiator(s) are below 0.1 parts by weight, capsules may not be formed due to poor polymerization. In contrast, if it exceeds 10 parts by weight, the capsule can be unstable because the resulting polymer will have low molecular weight.

The solvent for the capsule composition is water or alcohol or a mixture of solvents selected from alcohol (methanol, ethanol, isopropanol, phenol, t-butanol, etc.) and common organic solvents.

The present invention also relates to a method for preparing capsule composition, which comprises: a step of mixing and stirring 0.1–30 parts by weight of coloring compounds, 0.1–60 parts by weight of developer(s), 15–80 parts by weight of radical-polymerizable monomer(s), 0.1–10 parts by weight of radical polymerization initiator(s) and 20–80 parts by weight of solvents; and a step of polymerizing the mixture at 50–150° C. for 2 hr–7 days.

The above compostion can further comprise surfactant(s) or a mixture of surfactant(s) in the amount of 0.1~40 parts by weight with reference to the total composition. Surfactants used in the present invention are one or more known surfactant(s) selected from the group consisting of sodium dodecylsulfate, sodium laurylsulfate, Tween (polyoxyethylene sorbitan monolaurate, hereunder referred to as Tween) 20, Tween 40, Tween 60, Tween 80, sorbitan trioleate (Span; hereunder referred to as Span) 80, Span 85, cetyltrimethylammonium bromide (CTAB) and calcium lignosulfonate. Surfactants improve dispersibility in oil phase and water phase in order to form fine emulsion capsule for some dyes. Further, the capsule composition can further comprise in the amount of 0.05–15 wt. % of one or more of the following compounds, purchased from Aldrich or Tokyo Kase, or synthesized by known methods: formazane, naphtopyran, fulgide, azobenzene, disperse red, disperse orange, phthalocyanine, β- or γ-quinacridone, known organic pigment, inorganic pigment and dye [Handbook of Imaging Materials, Ed. by Arthur S. Diamond, Marcel Dekker, Inc., New York, pp. 234–235; Pigment Chemistry, Korean Studies Information Co., Ltd., ISBN: 89-89559-08-1, Reg. No. 6-0537; Dye Chemistry, Dae Kwang Publishing, ISBN: 89-384-0515, Reg. No. 10-24].

Still further, the capsule composition can further comprise in the amount of less than 50 wt. % of the total compositon of at least one compounds selected from the group consisting of poly(styrene-malecianhydride) (random, block), poly (styrene-butylmethacrylate) random copolymer, non-bridged polyester imide, polyurethane resin, polyvinyl chloride, polyolefine, gelatin, cellulose, melamine, polyurethane, polymethyl methacrylate, polycarbonate, epoxy resin of known oligomer of bisphenol A, diepoxy acrylic acid, wax of known (e.g. Polypropylene wax), charge controlling agent of known, polyvinyl acetate, vinyl chloride-vinyl acetate copolymer, polystyrene, phenoxy, polyester, aromatic polyester, maleic acid anhydride copolymer, polyvinyl alcohol, modified polyvinyl alcohol, hydroxyethyl cellulose, carboxymethyl cellulose, starch, methanol, ethanol, isopropanol, n-butanol or methyl isocarbinol; acetone, 2-butanol, ethyl amyl ketone, diacetone alcohol, isophorone or cyclohexanone; N,N-dimethylformamide or N,N-dimethylacetamide; diethyl ether, diisopropyl ether, tetrahydrofuran, 1,4-dioxane or 3,4-dihydro-2H-pyran; 2-methoxy ethanol, 2-ethoxy ethanol, 2-butoxy ethanol or ethylene glycol dimethyl ether; methyl acetate, ethyl acetate, isobutyl acetate, amyl acetate, ethyl lactone, ethylene carbonate, benzene, toluene or xylene; aliphatic hydrocarbon like hexane, hepatane, isooctane and cyclohexane; methylene chloride, 1,2-dichloroethane, dichloropropane or chlorobenzene; dimethylsulfoxide; N-methyl-2-pyrrolidone or N-octyl-2-pyrrolidone, an antioxidant, a thickener, an organic solvent, a surfactant and a UV blocking agent.

Hereunder is given a more detailed description of the method for preparing the capsule composition.

Firstly, coloring compounds and developer(s) are dissolved in radical-polymerizable monomer. This solution is cooled in ice bath, and a surfactant(s), radical polymerization initiator(s) and solvent(s) are added to this solution. This solution is stirred to obtain emulsion. In this process, a mechanical stirrer, a homogenizer, a sonicator, a paint shaker, a ball mill, an attritor, a three-roll mill, a Kedy mill, a sand mill, a Dyno mill or a colloid mill can be used to obtain the emulsion. The initiator(s) can be added before or after emulsification.

Then, polymerization is carried out at 50–150° C. for 2 hr–7 days to obtain core/shell-type capsule composition that contains a coloring layer. If the polymerization temperature is below 50° C., polymerization cannot be completed. Otherwise, if it exceeds 150° C., monomer and solvent may volatize. And, if the polymerization time is shorter than 2 hr, polymerization cannot be completed. In contrast, if it is longer than 7 days, the prepared capsule may be decomposed.

The present invention also relates to a method of applying the capsule composition on recording media like paper, OHP film or glass and a rewriting method of including the capsule composition in optical recording media, display element, recording element, lens, fiber or medicine and heating it over 160° C. to erase the recording.

That is, the capsule composition itself can be used as recording media in itself for recording on paper, OHP film or glass plate. And, it can be reused by heating the recorded material at a temperature over 160° C. to erase the recording. Further, this nanocapsule composition can be used in optical recording media, display element, recording element, lens, fiber or medicine.

The present invention also relates to a rewritable toner composition, which is prepared by melting 3–97 parts by weight of dry capsule particle and 0.01–50 parts by weight of charging material at 80–150° C.

Hereunder is given a more detailed description about the toner composition.

If the dry capsule particle content is below 3 parts by weight, the recording may not be detected. In contrast, if it exceeds 97 parts by weight, it is difficult to apply it on recording media like paper or film. The charging material functions as a charge controller. If its content is below 0.01 parts by weight or larger than 50 parts by weight, the charge control becomes inadequate.

Also, the toner composition can further comprise 0.01–97 parts by weight of one or more binding resin (binder)

selected from the group consisting of poly(styrene-butylmethacrylate) random copolymer, non-bridged polyester imide, polyurethane, polyvinyl chloride, polyolefine, gelatin, cellulose, melamine, polyurethane resin, polymethyl methacrylate resin, polycarbonate, epoxy resin, oligomer of bisphenol A and diepoxy acrylic acid. The binder improves binding (interaction) of capsules to recording media as well as mechanical property of the composition. If its content exceeds 97 parts by weight, the recording may not be detected.

Also, the toner composition can further comprise one or more components selected from the group consisting of wax of known (e.g. polypropylene wax), charge controlling agent of known, polyvinyl chloride resin, polyvinyl acetate resin, vinyl chloride-vinyl acetate copolymer, polystyrene resin, styrene copolymer, phenoxy resin, polyester resin, aromatic polyester resin, polyurethane resin, polycarbonate resin, polyacrylate resin, polymethacrylate resin, acrylic copolymer, maleic acid anhidride copolymer, polyvinyl alcohol resin, modified polyvinyl alcohol, hydroxyethyl cellulose resin, carboxymethyl cellulose resin, starch, methanol, ethanol, isopropanol, n-butanol or methyl isocarbinol; acetone, 2-butanol, ethyl amyl ketone, diacetone alcohol, isophorone or cyclohexanone; N,N-dimethylformamide or N,N-dimethylacetamide; diethyl ether, diisopropyl ether, tetrahydrofuran, 1,4-dioxane or 3,4-dihydro-2H-pyran; 2-methoxy ethanol, 2-ethoxy ethanol, 2-butoxy ethanol or ethylene glycol dimethyl ether; methyl acetate, ethyl acetate, isobutyl acetate, amyl acetate, ethyl lactone, ethylene carbonate, benzene, toluene or xylene; aliphatic hydrocarbon such as hexane, hepatane, isooctane and cyclohexane; methylene chloride, 1,2-dichloroethane, dichloropropane or chlorobenzene; dimethylsulfoxide; N-methyl-2-pyrrolidone or N-octyl-2-pyrrolidone.

If this toner composition is heated over 160° C., the recording is erased. Therefore, it can be used for rewritable recording media.

The following examples are aimed to be illustrative of the present invention. However, they should not be construed as limiting the scope of this invention.

EXAMPLE 1

Preparation of Capsule Composition

The capsule composition was prepared by using coloring compounds, a developer, an initiator and a monomer, synthesized by knowing knoiwn methods or purchased from Aldrich or TCI.

0.0717 g of 3,3-bis(p-dimethylaminophenyl)-6-dimethylaminophthalide (BDP) (coloring compound), 0.017 g of 4-hydroxy-4'-isopropoxy-diphenyl sulfone (HIS) (developer), 2.32 g of styrene monomer and 0.464 g of butylmethacrylate (BMA) comonomer were dissolved to obtain a mixture solution. This solution was stirred at 40° C. for 1 hr to obtain a blue mixture solution. 62 mg of N,N'-azo bisisobutyronitrile (AIBN) (initiator) was added to this solution. After stirring for 10 min, 28.7 mg sodium dodecylsulfate (SDS) (surfactant) dissolved in 12 g of water was added to this solution. Then, the mixture was stirred for another 30 min. The obtained mixture solution was sonicated for 2 min to obtain emulsion. All this procedure was carried out in ice bath in order to prevent polymerization of styrene.

While stirring this capsule solution at 400 rpm, polymerization was carried out at 70° C. for 12 hr. Upon completion of the reaction, the temperature was cooled down to room temperature to obtain blue polystyrene capsule composition. Constituents and reaction conditions of the capsule composition are shown in Table 1.

EXAMPLES 2–10

Preparation of Capsule Composition

Capsule composition was prepared as in Example 1 except for constituents, contents, reaction temperature and reaction time. Reaction conditions are given in Table 1.

TABLE 1

| | | Example | | | | | | | | | |
|---|---|---|---|---|---|---|---|---|---|---|---|
| Composition | | 1 | 2 | 3 | 4 | 5 | 6 | 7 | 8 | 9 | 10 |
| Coloring compounds (g) | BDP[1] | 0.0717 | | 7.17 | 7.17 | | | 17 | | 17 | 10 |
| | DMAF[2] | | 7.17 | | | | | | | | |
| | COSP[3] | | | | | 12 | | | | | |
| | MMA547[4] | | | | | | 15 | | | | |
| | DBF[5] | | | | | | | | 17 | | 10 |
| Developer (g) | HIS[6] | 0.017 | 7.7 | 14.7 | | 17 | | | | 10 | 10 |
| | Bisphenol A | | | | 7 | | 10 | | | 10 | 10 |
| | IPDH[7] | | | | | | | 20 | | | |
| | Diethyl phosphate | | | | | | | | 10 | | |
| Monomer (g) | Styrene | 2.32 | 2.32 | 2.32 | 2.32 | 2.32 | 2.32 | | 2.32 | 2.32 | 2.32 |
| | Methyl methacrylate | | | | | | | 2.32 | | | |
| Comonomer (g) | BMA[8] | 0.464 | | | 0.4 | 0.3 | 0.4 | | 0.4 | | |
| | Methyl methacrylate | | | | | 0.1 | | | | | |
| | Divinylbenzene | | | | | | | | 0.05 | | |
| Surfactant (g) | SDS[9] | 0.0287 | 29 | 29 | | | | | | | 29 |
| | Tween 40 | | | | 0.112 | 0.112 | 0.17 | 0.112 | 0.112 | | |
| | Span 80 | | | | 0.168 | 0.168 | 0.118 | 0.168 | 0.168 | | |
| Initiator (g) | AIBN | 0.062 | 0.5 | | 0.5 | 0.5 | 0.5 | 0.5 | 0.5 | 0.5 | |
| | PEGA[10] | | | 0.9 | | | | | | | |
| | BPO[11] | | | | | | | | | | 0.5 |
| Other additives | PVA = P, SMA[12] = S, Gelatine = G | | | | | | | | | S, 0.2 | P, 0.1, G, 0.05 |

TABLE 1-continued

| Composition | Example 1 | 2 | 3 | 4 | 5 | 6 | 7 | 8 | 9 | 10 |
|---|---|---|---|---|---|---|---|---|---|---|
| Solvent (g): Water = W, Methanol = M | W, 12 | W, 12 | W, 12 | W, 12 | W, 12 | W, 12 | W, 12 | W, 12 | M, 15 | 12 |
| Polymerization temperature (° C.) | 70 | 65 | 65 | 70 | 70 | 75 | 60 | 70 | 60 | 65 |
| Reaction time (hr) | 12 | 12 | 12 | 18 | 18 | 14 | 18 | 18 | 24 | 12 |

[1]BDP: 3,3-Bis(p-dimethylaminophenyl)-6-dimethylaminophthalide
[2]DMAF: 3'-Dibutylamino-6'-methyl-7'-anilinofluoran
[3]COSP: 6-(Hexyloxyphenyl)carbonyl substituted spirobenzopyran

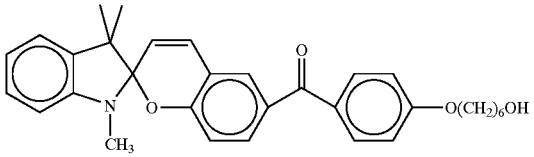

Ref: Eunkyung Kim, et. al, Tetrahedron Letters, Vol. 39, pp. 8861–8864 (1998)
[4]MMA547: 1,3-Dihydro-1,3,3-trimethylspiro[2H-indole-2,3'-[3H]-naphth[2,1-b][1,4]oxazine]
[5]DBF: 6-diethylamino-benzo[a]-fluoran
[6]HIS: 4-hydroxy-4'-isopropoxy-diphenyl sulfone
[7]IPDH: Following formula

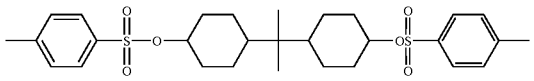

U.S. Pat. No. 4918046
[8]BMA: Buthylmethacrylate
[9]SDS: Sodium dodecylsulfate
[10]PEGA: Azo-polyethylene glycol (Formula 1),
Mw of polyethylene glycol = 300
[11]BPO: Benzoyl peroxide
[12]SMA = Styrene-co-maleic anhydride copolymer

EXPERIMENTAL EXAMPLE 1

Measurement of Color, Average Particle Diameter, Decomposition Temperature and Erasing Efficiency of Capsule Composition For capsule composition prepared in Example 1, color, average particle diameter, decomposition temperature and erasing efficiency were measured as follows:

(1) Color: The capsule composition prepared in Example 1 was dropped on OHP film using a pipette. When the OHP film was dried at room temperature, blue recording was identified.

(2) Average particle diameter: The capsule composition prepared in Example 1 was diluted to 0.01 parts by weight in ethanol. The solution was dropped on copper grid coated with 200-mesh carbon. After the solution was dried, TEM analysis was carried out. The result is shown in FIG. 1. Average particle diameter of the capsule composition was identified to be 70 nm.

(3) Decomposition temperature (heat resistance): Decomposition temperature of the capsule composition prepared in Example 1 was measured using thermogravimetry analyzer. The decomposition temperature was identified to be 230° C.

(4) Erasing efficiency (%): Absorption of the capsule composition prepared in Example 1 at maximum wavelength was measured using UV/Vis spectrometer. After passing the recorded part to 160° C. of laminator for 1 sec, absorption at maximum wavelength was measured using UV/Vis spectrometer. Discoloring, calculated by Equation 1, was 95%.

$$\text{Erasing efficiency (\%)}=[(\text{Initial absorption}-\text{Absorption after erasing})/\text{Initial abosorption}]\times 100 \quad \text{Equation 1}$$

EXPERIMENTAL EXAMPLES 2–10

Measurement of Color, Average Particle Diameter, Decomposition Temperature and Erasing Efficiency of Capsule Composition The same test was carried out for capsule compositions prepared Examples 2–10. The results are shown in Table 2.

TABLE 2

| Testing Example | Capsule composition | Color | Average particle diameter (nm) | Decomposition temperature (° C.) | Erasing temperature (° C.) | Erasing efficiency (%) |
|---|---|---|---|---|---|---|
| 1 | Example 1 | Blue | 70 | 230 | 160 | 95 |
| 2 | Example 2 | Black | 150 | 240 | 160 | 60 |

TABLE 2-continued

| Testing Example | Capsule composition | Color | Average particle diameter (nm) | Decomposition temperature (° C.) | Erasing temperature (° C.) | Erasing efficiency (%) |
|---|---|---|---|---|---|---|
| 3 | Example 3 | Blue | 200 | 245 | 160 | 80 |
| | | | | | 180 | 90 |
| 4 | Example 4 | Blue | 90 | 220 | 160 | 90 |
| | | | | | 200 | 95 |
| 5 | Example 5 | Violet | 150 | 215 | 160 | 80 |
| 6 | Example 6 | Blue | 200 | 230 | 160 | 70 |
| 7 | Example 7 | Blue | 100 | — | — | — |
| 8 | Example 8 | Red | 120 | — | — | — |
| 9 | Example 9 | Blue | 150 | 245 | 160 | 80 |
| 10 | Example 10 | Violet | 250 | 245 | 160 | 90 |

As shown in Table 2, the capsule composition according to the present invention is offered in blue, red and violet color as well as in black. Therefore, it can be used as a color recording material.

Average particle diameter of the capsule composition was 70–250 nm, which is much finer compared to conventional ones at the level of a few micrometers in size. Further, because the decomposition temperature is above 200° C. and the erasing temperature is 160° C., the capsule composition of this invention is thermally stable and can be applied when high resolution is required.

In addition, because erasing efficiency of the capsule composition at 160° C. is as high as 60–95%, it can be used as a thermosensitive material for rewritable recording media.

EXAMPLE 11

Preparation of Toner Composition

Toner composition was prepared from the capsule composition prepared in Example 1. The capsule composition prepared in Example 1 was filtered and dried in an oven kept at 70° C. to obtain dry capsule particles.

40 g of the dry particles were mixed with 1.2 g of polypropylene (PP) wax (Mw: 4000 g/mol) and 0.4 g of charging material (Bontron S-34; Orient Chemical) for 20 min at 120° C. The mixture was cooled down to room temperature to finally obtain blue toner.

EXAMPLES 12–17

Preparation of Toner Composition

Toner composition was prepared as in Example 11 except for capsule compositions, content of dry capsule particles, additives, mixing temperature and mixing time. Prepration conditions are given in Table 3.

TABLE 3

| Example | Capsule composition | Dry capsule particle (g) | Additive (g) | Mixing temperature (° C.) | Mixing time (min) |
|---|---|---|---|---|---|
| 11 | Example 1 | 40 | Wax (1.2); CCA[2] (0.4) | 120 | 20 |
| 12 | Example 2 | 40 | Wax (1); CCA (1) | 100 | 15 |
| 13 | Example 3 | 35 | Wax (1); SB[1] (5); CCA (1) | 120 | 10 |
| 14 | Example 4 | 35 | Wax (1); SB[1] (5); CCA (1) | 120 | 10 |
| 15 | Example 7 | 35 | Wax (1); SB[1] (5) | 130 | 10 |
| 16 | Example 8 | 35 | Wax (1); SB[1] (10); CCA (1.5) | 130 | 10 |
| 17 | Example 1 | 30 | Wax (1); Non-bridged polyester imide (10); CCA (2) | 130 | 10 |

[1]SB: Poly(styrene-butylmethacrylate) random copolymer
[2]CCA: Charge controlling agent

TESTING EXAMPLES 11–17

Measurement of Color, Decomposition Temperature and Erasing Efficiency of Toner Composition The same test was carried out for toner compositions prepared in Examples 11–17. The result is shown in Table 4.

TABLE 4

| Experimental Example | Capsule composition | Toner color | Decomposition temperature (° C.) | Erasing temperature (° C.) | Erasing efficiency (%) |
|---|---|---|---|---|---|
| 11 | Example 11 | Blue | 220 | 165 | 70 |
| 12 | Example 12 | Black | 240 | 160 | 60 |
| 13 | Example 13 | Blue | 245 | 160 | 80 |
| | | | | 180 | 90 |
| 14 | Example 14 | Blue | 220 | 160 | 90 |
| | | | | 200 | 95 |
| 15 | Example 15 | Blue | 215 | 160 | 80 |
| 16 | Example 16 | Red | 230 | 160 | 90 |
| 17 | Example 17 | Blue | 230 | 160 | 70 |

As shown in Table 4, toner composition according to the present invention is offered in blue color as well as in black.

And, because the decomposition temperature is above 200° C. and the erasing temperature is 160° C., the capsule composition of this invention is thermally stable and can be applied when high resolution is required.

Further, because erasing efficiency of the capsule composition at 160° C. or 200° C. is as high as 60–95%, it can be used as a thermosensitive material for rewritable recording media.

In addition, because it is unnecessary to crush toner composition to fine particles, energy consumption can be much reduced.

As explained in detail above, the capsule composition according to the present invention is a core/shell-type nanoparticle compositon, which has superior recording characteristics and heat stability. Therefore, it is suitable for high-resolution electrostatic image toner, paper, film, etc. Further, because the capsule composition according to this invention can be used for rewritable recording media, environmental problems related with recording media waste can be substantially minimized.

What is claimed is:

1. A capsule composition comprising 0.1–30 parts by weight of coloring compound(s), 0.1–60 parts by weight of developer(s), 15–80 parts by weight of radical-polymerizable monomer(s), 0.1–10 parts by weight of radical polymerization initiator(s), and 20–80 parts by weight of solvent(s), wherein said radical-polymerizable monomer(s) surrounds said coloring compound(s) and developer(s) in a core/shell structure.

2. The capsule composition according to claim 1, wherein the diameter of said capsule is in the range of from 10–3000 nm.

3. The capsule composition according to claim 1, wherein said coloring compound(s) are one or more compounds selected from the group consisting of: fluoran, phthalide, spiropyran, spiroxazine, diarylethene, and azobenzene.

4. The capsule composition according to claim 1, wherein said developer(s) are one or more compounds selected from the group consisting of: a —OH containing compound, a —$PO(OH)_2$ containing compound, monosulfate, bisulfate, citric acid, gallic acid, succinic acid, lactic acid, tartaric acid, valeric acid, DL-malic acid, and gluconic acid.

5. The capsule composition according to claim 1, wherein said radical-polymerizable monomer(s) are one or more compounds selected from the group consisting of: substituted or unsubstituted compounds containing an unsaturated group such as styrene, alkyl acrylate, polyalkylene glycol acrylate, acrylic acid, and vinylcarbazole.

6. The capsule composition according to claim 1, wherein said composition further comprises one or more compounds selected from the group consisting of: formazane, naphtopyran, fulgide, azobenzene, disperse red, disperse orange, phthalocyanine, pigment(s), and dye(s).

7. The capsule composition according to claim 1, wherein said composition further comprises one or more compounds selected from the group consisting of: polyvinylalcohol, polyester, gelatin, cellulose, melamine, polyurethane resin, polymethyl methacrylate resin, polycarbonate, epoxy resin, oligomer of bisphenol A, and diepoxy acrylic acid, said capsule composition further including: an antioxidant, a thickener, an organic solvent, a surfactant, and a UV blocking agent.

8. A method for preparing a capsule composition comprising steps of:

(a) mixing and stirring 0.1–30 parts by weight of coloring compound(s), 0.1–60 parts by weight of developer(s), 15–80 parts by weight of radical-polymerizable monomer(s), 0.1–10 parts by weight of radical polymerization initiator(s), and 20–80 parts by weight of solvent(s) to obtain emulsion; and (b) polymerizing the emulsion at 50–150° C. for 2 hr(s)–7 days.

9. The method for preparing a capsule composition according to claim 8, said radical-polymerizable monomer(s) being added before or after emulsification.

10. A toner composition comprising 3–97 parts by weight of dry capsule particles obtained by drying a capsule composition according to claim 1 and 0.01–50 parts by weight of a charge controlling agent, said toner composition being prepared by melting at 80–150° C.

11. The toner composition according to claim 10, wherein said composition further comprises 0.01–97 parts by weight of binding resin.

12. The capsule composition according to claim 1, wherein said composition further comprises a surfactant or a mixture of surfactants in the amount of 0.1–10 parts by weight with reference to the total composition.

13. The method for preparing a capsule composition according to claim 8, wherein said composition further comprises a surfactant or a mixture of surfactants in the amount of 0.1–10 parts by weight with reference to the total composition.

14. The capsule composition according to claim 2, wherein said composition further comprises one or more compounds selected from the group consisting of: polyvinylalcohol, polyester, gelatin, cellulose, melamine, polyurethane resin, polyether methacrylate resin, polycarbonate, epoxy resin, oligomer of bisphenol A, and diepoxy acrylic acid, said capsule composition further including: an antioxidant, a thickener, an organic solvent, a surfactant, and a UV blocking agent.

15. The capsule composition according to claim 3, wherein said composition further comprises one or more compounds selected from the group consisting of: polyvinylalcohol, polyester, gelatin, cellulose, melamine, polyurethane resin, polyether methacrylate resin, polycarbonate, epoxy resin, oligomer of bisphenol A, and diepoxy acrylic acid, said capsule composition further including: an antioxidant, a thickener, an organic solvent, a surfactant, and a UV blocking agent.

16. The capsule composition according to claim 4, wherein said composition further comprises one or more compounds selected from the group consisting of: polyvinylalcohol, polyester, gelatin, cellulose, melamine, polyurethane resin, polyether methacrylate resin, polycarbonate, epoxy resin, oligomer of bisphenol A, and diepoxy acrylic acid, said capsule composition further including: an antioxidant, a thickener, an organic solvent, a surfactant, and a UV blocking agent.

17. The capsule composition according to claim 5, wherein said composition further comprises one or more compounds selected from the group consisting of: polyvinylalcohol, polyester, gelatin, cellulose, melamine, polyurethane resin, polyether methacrylate resin, polycarbonate, epoxy resin, oligomer of bisphenol A, and diepoxy acrylic acid, said capsule composition further including: an antioxidant, a thickener, an organic solvent, a surfactant, and a UV blocking agent.

18. The capsule composition according to claim 6, wherein said composition further comprises one or more compounds selected from the group consisting of: polyvinylalcohol, polyester, gelatin, cellulose, melamine, polyurethane resin, polyether methacrylate resin, polycarbonate, epoxy resin, oligomer of bisphenol A, and diepoxy acrylic acid, said capsule composition further including: an antioxidant, a thickener, an organic solvent, a surfactant, and a UV blocking agent.

19. A toner composition comprising 3–97 parts by weight of dry capsule particles obtained by drying a capsule composition according to claim 2 and 0.01–50 parts by weight of a charge controlling agent, said toner composition being prepared by melting at 80–150° C.

20. The toner composition according to claim 19, wherein said composition further comprises 0.01–97 parts by weight of binding resin.

21. A toner composition comprising 3–97 parts by weight of dry capsule particles obtained by drying a capsule composition according to claim 3 and 0.01–50 parts by weight of a charge controlling agent, said toner composition being prepared by melting at 80–150° C.

22. The toner composition according to claim 21, wherein said composition further comprises 0.01–97 parts by weight of binding resin.

23. A toner composition comprising 3–97 parts by weight of dry capsule particles obtained by drying a capsule composition according to claim 4 and 0.01–50 parts by weightof a charge controlling agent, said toner composition being prepared by melting at 80–150° C.

24. The toner composition according to claim 23, wherein said composition further comprises 0.01–97 parts by weight of binding resin.

25. A toner composition comprising 3–97 parts by weight of dry capsule particles obtained by drying a capsule composition according to claim 5 and 0.01–50 parts by weight of a charge controlling agent, said toner composition being prepared by melting at 80–150° C.

26. The toner composition according to claim 25, wherein said composition further comprises 0.01–97 parts by weight of binding resin.

27. A toner composition comprising 3–97 parts by weight of dry capsule particles obtained by drying a capsule composition according to claim 6 and 0.01–50 parts by weight of a charge controlling agent, said toner composition being prepared by melting at 80–150° C.

28. The toner composition according to claim 27, wherein said composition further comprises 0.01–97 parts by weight of binding resin.

29. A method of re-recording on recording media including the capsule composition of claim 1, the method comprising erasing recording previously made on said recording media by heating said recording media to a temperature over 160° C. followed by re-recording on said recording media.

30. A method of re-recording on recording media including the capsule composition of claim 2, the method comprising erasing recording previously made on said recording media by heating said recording media to a temperature over 160° C. followed by re-recording on said recording media.

31. A method of re-recording on recording media including the capsule composition of claim 3, the method comprising erasing recording previously made on said recording media by heating said recording media to a temperature over 160° C. followed by re-recording on said recording media.

32. A method of re-recording on recording media including the capsule composition of claim 4, the method comprising erasing recording previously made on said recording media by heating said recording media to a temperature over 160° C. followed by re-recording on said recording media.

33. A method of re-recording on recording media including the capsule composition of claim 5, the method comprising erasing recording previously made on said recording media by heating said recording media to a temperature over 160° C. followed by re-recording on said recording media.

34. A method of re-recording on recording media including the capsule composition of claim 6, the method comprising erasing recording previously made on said recording media by heating said recording media to a temperature over 160° C. followed by re-recording on said recording media.

* * * * *

UNITED STATES PATENT AND TRADEMARK OFFICE

CERTIFICATE OF CORRECTION

PATENT NO. : 6,953,645 B2 
DATED : October 11, 2005
INVENTOR(S) : Eun Kyoung Kim, Young Soon Kim and Soo Kyung Kim It is certified that error appears in the above-identified patent and that said Letters Patent is hereby corrected as shown below:

Title page,
Item [74], *Attorney, Agent, or Firm*, "Dunnrer" should read -- Dunner, --.

Column 17,
Line 22, "weightof" should read -- weight of --.

Signed and Sealed this

Thirty-first Day of January, 2006

JON W. DUDAS
*Director of the United States Patent and Trademark Office*